US006289525B1

(12) United States Patent
Prommer et al.

(10) Patent No.: US 6,289,525 B1
(45) Date of Patent: Sep. 18, 2001

(54) DOSING APPARATUS

(75) Inventors: Friedbert Prommer, Reicharthausen (DE); Stanislaw Tomkow, Wrozlaw (PL)

(73) Assignee: Martin Angst (DE)

( * ) Notice: Subject to any disclaimer, the term of this patent is extended or adjusted under 35 U.S.C. 154(b) by 0 days.

(21) Appl. No.: 09/494,009

(22) Filed: Jan. 28, 2000

(51) Int. Cl.[7] ..... E03D 9/02
(52) U.S. Cl. ..... 4/227.2
(58) Field of Search ..... 4/227.1–227.3

(56) References Cited

U.S. PATENT DOCUMENTS

| | | | | |
|---|---|---|---|---|
| 3,254,797 | * | 6/1966 | Porter | 4/227.3 X |
| 3,701,614 | | 10/1972 | Guidicelli . | |
| 4,962,549 | | 10/1990 | King . | |

FOREIGN PATENT DOCUMENTS

| | | | | |
|---|---|---|---|---|
| 2833770 | | 2/1979 | (DE) . | |
| 3836189 | * | 4/1990 | (DE) | 4/227.2 |
| 3908178 | | 9/1990 | (DE) . | |
| 4400766 | | 7/1995 | (DE) . | |
| 19637034 | | 3/1998 | (DE) . | |
| 0341035 | | 8/1989 | (EP) . | |
| 1403785 | | 3/1965 | (FR) . | |
| 2046599 | | 3/1971 | (FR) . | |
| 1199610 | | 7/1970 | (GB) . | |

* cited by examiner

*Primary Examiner*—Charles E. Phillips
(74) *Attorney, Agent, or Firm*—Andrus, Sceales, Starke & Sawall

(57) ABSTRACT

The invention relates to an apparatus for releasing a predetermined amount of a free-flowing medium into a fluid container, in particular the flushing cistern of a water closet. The apparatus comprises a pump, in particular diaphragm pump, which comprises an actuating plunger (6) that cooperates with a diaphragm (5) and is movable upward and downward by means of a float (7) as a result of change in the water level within the fluid container (20). The apparatus further comprises a reservoir (2) for the free-flowing medium, which is coupled to the input of the diaphragm pump, and a nonreturn valve (9) associated with an output (22) of the diaphragm pump. It is provided in accordance with the invention that the diaphragm (5) has a sacklike form and that the actuating plunger (6) acts at the end of the sack in such a way that during such action the diaphragm sack (5) is indented so as to enclose the contact surface **(6*a*) of the plunger (6). The invention further relates to a holding device with which to attach the apparatus described above to a fluid container. It is provided in accordance with the invention that the holding device comprises a support rod (22) that can be attached at one end to a cage (25) or pump housing (3) and at its other end to the fluid container (20)**.

12 Claims, 3 Drawing Sheets

DOSING APPARATUS

BACKGROUND OF THE INVENTION

The invention relates to an apparatus for releasing a predetermined amount of a free-flowing medium into a fluid container, in particular the flushing cistern of a WC.

As the free-flowing medium, in particular foaming agents, foam or the like are provided. The foaming agent serves to produce a closed-pore carpet of foam within a toilet bowl or similar vessel. Trials have shown that the most commonly used foaming agents and/or the foam they generate tend to acquire a "gelatinous" quality when they are in contact with air, with the result that after the apparatus has not been used for a long time, the discharge opening or valve for the foaming agent or foam becomes occluded. Hence after a long period of disuse the apparatus is no longer functional.

The German patent DE 39 08 178 A1 discloses an apparatus of the kind cited above. In this apparatus the container for the free-flowing medium is constructed as a flexible bag, into which the medium is put without any air inclusions. As the flowing medium is released, the bag collapses correspondingly, so that no introduction of air can occur. The flowing medium is coupled to an input of a diaphragm pump by way of a nonreturn valve. At an output of the diaphragm pump an outlet pipe is attached by way of another nonreturn valve. The open end of the outlet pipe is situated in a fluid container. The diaphragm pump comprises a flat diaphragm, which is deformed by means of an actuating plunger. The actuating plunger is moved by a float attached to a lever. The lever is one-sided, such that the float is further away from the fulcrum of the lever than is the actuating plunger. Hence the force acting on the plunger is greater than the force generated by the buoyancy of the float. In an alternative embodiment, the float is disposed below the plunger. In this case the buoyancy of the float is equal to the force with which the plunger acts on the diaphragm. If the fluid container is a flushing cistern for a WC, one pumping cycle of the diaphragm pump corresponds to a single process of flushing and refilling the cistern.

Such an apparatus has the disadvantage that for the flat diaphragm a relatively large amount of force must be applied. Furthermore, the use of a lever makes the construction relatively elaborate. A diaphragm pump with a flat diaphragm also has the disadvantage that the change in volume is relatively small in comparison to the volume of the pumping chamber. The result is that the size of the discharged dose of flowing medium is limited; in addition, the dosage cannot be precisely determined. The shape of the pumping chamber furthermore makes it more likely that residues of the flowing medium will remain therein. The known apparatus, finally, has the further disadvantage that it is relatively cumbersome to install in a flushing cistern. The apparatus must be attached to the cistern at several points. Moreover, the apparatus or at least its supporting device must be matched to the particular cistern with respect to its geometric dimensions. Hence for nearly every type of cistern it is necessary to have a special embodiment of the apparatus described above, or of its supporting device. Therefore the manufacturing costs are high.

Taking as a starting point the state of the art according to DE 39 08 178 A1, it is the object of the present invention to make available an apparatus for releasing a predetermined amount of a free-flowing medium in which the force to operate the diaphragm pump is reduced, the relative volume change in the pumping chamber is increased and the construction is made less elaborate. Furthermore, the apparatus is designed to be installable by simple means in nearly all commercially available flushing cisterns, the number of fixation elements being kept as small as possible.

SUMMARY OF THE INVENTION

It is provided in accordance with the invention that the diaphragm is constructed in a sacklike form and the actuating plunger acts at the end of the sack, in such a way that when the plunger presses on the diaphragm sack, the latter is indented so as to enclose the contact surface.

Because of the sacklike construction of the diaphragm, a relatively large change in volume of the pumping chamber is achieved. The mechanical properties of the sacklike diaphragm are such that the amount of force required to deform it is relatively small. As a result, there is no need for a structurally complicated movement mechanism for the actuating plunger.

The actuating plunger further preferably comprises a contact surface that is dome- or mushroom-shaped. This configuration contributes to further reducing the amount of force required, because the area over which the actuating plunger touches the diaphragm increases with increasing depth of diaphragm indentation. Hence the pressure exerted by the actuating plunger on the membrane decreases continuously with increasing indentation depth. This is consistent with the amount of pressure needed to deform the sacklike diaphragm, which is greatest in the initial phase of the indentation process.

In one preferred embodiment the float is held so that it can move up and down within a cage that is fixedly disposed with respect to the diaphragm pump, in particular attached thereto. The cage serves as a protective device for the float and ensures that the float can move exclusively in the vertical direction.

The diaphragm pump and/or the cage are preferably attachable to the fluid container by means of a holding device. This arrangement ensures a stable, spatially fixed mounting of the diaphragm pump and/or the cage, which is advantageous with respect to keeping the force for actuating the pump small.

Preferably the float is constructed as a hollow body opening downwards, in particular a pot-like structure. As a result, when the fluid container is emptied, the downwards-acting force is increased. Therefore a more rapid filling of the pumping chamber is achieved. Conversely, during introduction of water into the fluid container or flushing cistern the rate of rise of the actuating plunger is reduced. Thus the displacement of the free-flowing medium out of the pumping chamber is delayed.

In addition, in a manner known per se, the reservoir for the flowing medium can be a flexible bag, which preferably is made of a multilayered film. The multilayered film can, for example, comprise an aluminum, polyethylene, PVC and/or plasticized-PVC film. In particular, a multilayered film is provided that is impermeable to solvent vapor, for example alcohol vapor. This contributes to the functional reliability of the apparatus.

Preferably the apparatus comprises an adjustable stop, which limits the upward movement of the float. This adjustable stop in particular allows the dosage of the flowing medium to be determined. Furthermore, the maximal height of the float can be altered to suit the fluid container or flushing cistern. Because the apparatus is to be used for different types of liquid containers, the diaphragm and the float are exposed to differing hydrostatic pressures, to which the apparatus can be adjusted by means of the adjustable stop.

In particular, the membrane and the actuating plunger are made substantially rotationally symmetrical and are so disposed that they have a common axis of rotational symmetry. This contributes to the functional reliability and to minimizing the force required.

Preferably the diameter of the contact surface of the actuating plunger is about ¼ to ⅕ of the diameter of the diaphragm. With these dimensions, the functional reliability of the apparatus is optimized.

In addition, the float and the actuating plunger are preferably displaceable in the direction of a common axis. As a result, the overall buoyancy of the float is transmitted substantially directly to the actuating plunger.

The diaphragm is preferably made of rubber or similar elastic material. By this means damage to the diaphragm is largely ruled out and it is guaranteed to have a long working life.

The diaphragm pump advantageously comprises a diaphragm chamber into which the sacklike diaphragm extends and within which the actuating plunger cooperates with the diaphragm, the diaphragm chamber being provided with apertures by way of which its interior is in fluid communication with the fluid container. By this means the pressing action of the plunger is reinforced by the hydrostatic pressure of the water that passes through the apertures into the diaphragm chamber. As a result, the efficiency of the pump can be increased.

The diaphragm chamber advantageously comprises at least one vent. This allows water to be substantially unhindered as it enters the diaphragm chamber from below; and air enclosed within the diaphragm chamber can escape from the chamber as it is compressed upward.

Regarding a holding device to attach the apparatus described above to a fluid container, it is provided in accordance with the invention that the holding device comprises a support rod which at one end is connected to a cage or pump housing and by the other end can be attached to the fluid container. Such a holding device enables a particularly simple installation of the apparatus in the fluid container.

Furthermore, the support rod can be connected to the pump housing by way of a joint. The joint can have the form of a universal or hinge joint. The result is that the holding device can be brought into the fluid container even if the interior of the fluid container is not readily accessible. This applies in particular to concealed or recessed flushing cisterns, the interior of which is usually accessible only through a relatively restricted opening in the side wall of the cistern.

Preferably the support rod comprises a plurality of preformed break sites, spaced apart from one another in the longitudinal direction, so that the length of the support rod can be adjusted to suit the size or specific shape of the fluid container. In this case the preformed break sites can be positioned so that there is one to match each type of flushing cistern, and immediately before installation the length of the support rod can be altered according to the particular cistern involved.

Additional characteristics, advantages and particular embodiments of the invention will be apparent from the subordinate claims.

DESCRIPTION OF DRAWINGS

In the following the invention is explained with reference to the attached drawings, wherein.

DESCRIPTION OF ILLUSTRATED EMBODIMENTS

Figure 1:
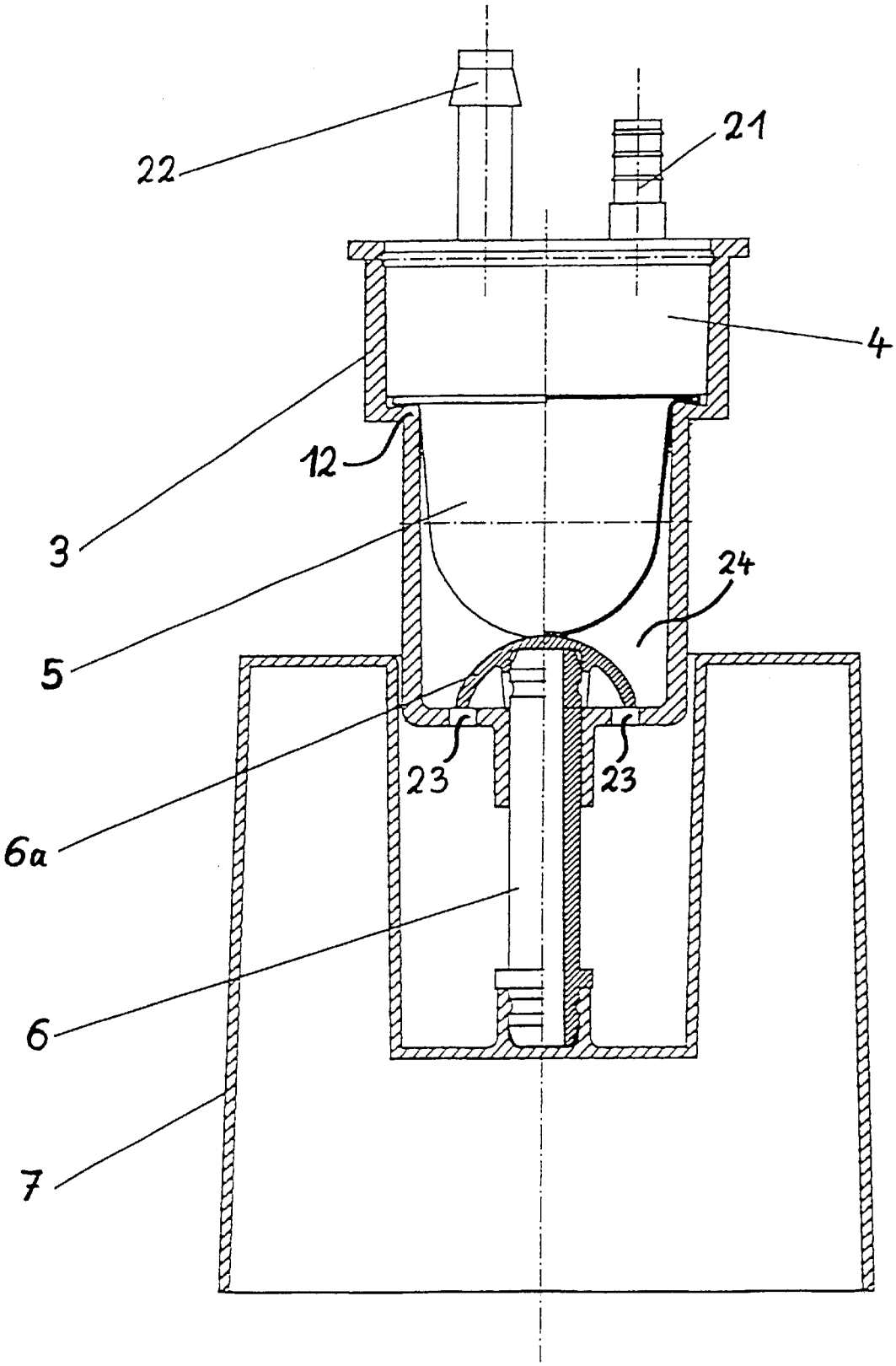
FIG. 1 is a sectional side view of a diaphragm pump of the apparatus in accordance with the invention.

FIG. 1 shows a diaphragm pump as viewed in section from the side, with a float 7. The pump comprises a pump housing 3, in the upper region of which a dosing chamber 4 is situated. At the upper side of the dosing chamber 4 are disposed an input connection 21 and an output connection 22, to each of which a tube or the like can be attached. In the lower region of the pump housing 3 is a diaphragm 5 with a sacklike shape. The open end of the diaphragm 5 is connected to the dosing chamber 4, so that the interior of the dosing chamber 4 and the space enclosed by the diaphragm sack 5 form a single compartment. The approximately hemispherical surface of the diaphragm 5 is convex downward. The diaphragm 5 subdivides the pump housing into two chambers, namely the dosing chamber 4 and a diaphragm chamber 24. In the middle of the underside of the pump housing 3 is a vertical bore. This bore serves to guide an actuating plunger, which is displaceable in the vertical direction. At its upper end the actuating plunger 6 comprises an approximately hemispherical head 6*a*. The curved part of the head 6*a* is convex upward and abuts against the diaphragm 5. The head 6*a* is thus situated in the lower region of the pump housing 3, between the diaphragm 5 and the underside of the pump housing 3. At its lower end the actuating plunger 6 is rigidly connected to the float 7. The float 7, together with the plunger 6, can be displaced in the vertical direction. The float 7 is constructed as a hollow body open downward, and it partly encloses the lower region of the pump housing 3. The float 7 is of particularly light and thin-walled construction. In the bottom wall of the pump housing 3 are situated apertures to allow the flow of fluid, and in the upper region of the diaphragm chamber 24 there is a vent.

The diaphragm pump shown in FIG. 1 with the float 7 is intended for installation in a fluid container, in particular in a WC flushing cistern. The position of the float 7 depends on the water level in the cistern. When the cistern is emptied, the float 7 and with it the actuating plunger 6 sink downward. Through the apertures 23 water enters the diaphragm chamber 24, within which the diaphragm 5 and plunger 6 are in contact with one another. Because both the diaphragm 5 and the plunger 6 are wet, they adhere to one another. As a result, when the plunger 6 moves downward, it pulls the diaphragm 5 into the shape of its fully extended profile so that in the interior of the diaphragm sack 5, and hence in the dosing chamber 4, a subatmospheric pressure is produced which accelerates the suction of a freely-flowing medium into the diaphragm pump. Furthermore, it is a property of the diaphragm 5 that it assumes the shape of the full profile when no external force is acting on it. Suction of the flowing medium into the membrane pump is further promoted by the force of gravity. When the flushing cistern fills, the float 7 rises and hence the actuating plunger 6 moves upward. The plunger 6 presses against the diaphragm 5. Because water flows into the diaphragm chamber 24 through the apertures 23, the water assists the plunger 6 in pressing the flowing medium out of the dosing chamber 4. These effects suffice to overcome the resistance to flow through a nonreturn valve that can be connected to the output 22. The vent 12 in the diaphragm chamber 24 ensures that there is no substantial resistance to the entry of water through the apertures 23 into the diaphragm chamber 24, and that air enclosed within the diaphragm chamber 24 can escape upward, out of the diaphragm chamber 24.

Because on one hand the diaphragm 5 has a sacklike shape, while on the other hand the actuating plunger 6 has a dome- or mushroom-like head 6*a*, the diaphragm 5 is pressed inward by the plunger 6 so as to enfold the head 6*a*. As a result of the geometrical configuration of the diaphragm 5 and head 6*a*, an especially small amount of force is needed to actuate the diaphragm pump.

Emptying of the flushing cistern is completed in a few seconds, whereas filling takes considerably longer. Any change in water level within the cistern causes the float 7 also to change its height. The construction of the float 7 as a hollow body opening downward acts to delay the ascent of the float 7 while the flushing cistern is filling with water. Conversely, this same construction of the float 7 accelerates sinking of the float 7 during emptying of the cistern.

Figures 2A, 2B, 2C:
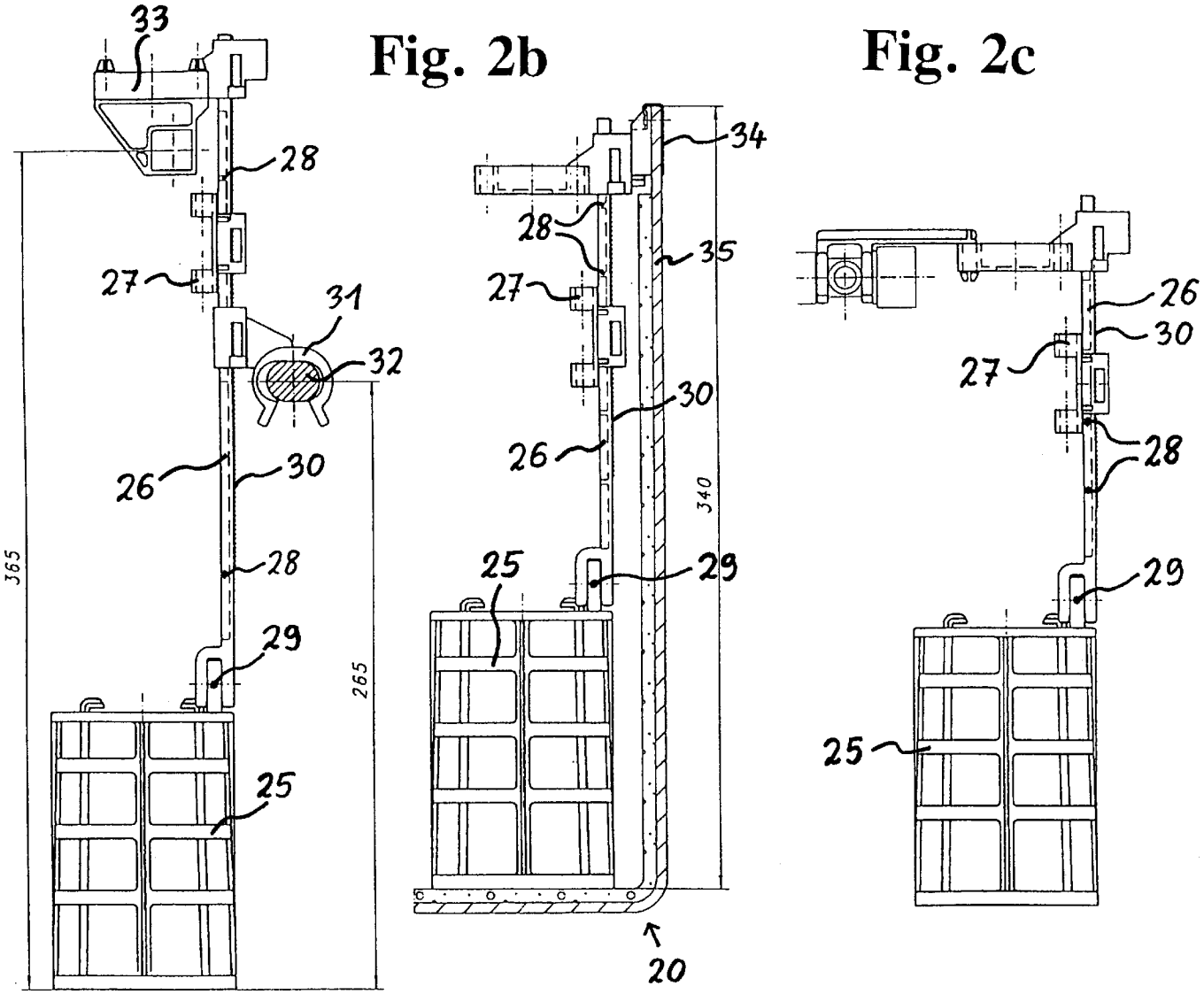
FIGS. 2*a–c* show side views of three embodiments of the holding device in accordance with the invention, with a cage.

In FIGS. 2*a–c*, three embodiments of a holding device in accordance with the invention are shown. The holding device is provided to attach the apparatus according to FIG. 1 within a flushing cistern 20. The three embodiments of the holding device differ with respect to the means of fixation used to attach the holding device to the cistern 20. All three embodiments of the holding device according to FIG. 2*a*, 2*b* and 2*c* comprise a support rod 26 with a plurality of preformed break sites 28 and a tube holder 27. All three holding devices are further connected to a cage 25 by means of a hinge joint 29. The preformed break sites 28 are spaced apart from one another in the long direction of the support rod 26. Hence the length of the support rod 26 can be adjusted according to the interior shape, in particular the height of the flushing cistern 20. The support rod 26 is rectangular in cross section. On one broad side of the support rod 26 a toothed rack 30 is provided. The tube holder 27 and, where appropriate, additional holding elements can be brought into engagement with the rack 30.

The holding device shown in FIG. 2*a* is attachable to a transverse connecting brace 32 by means of a fixation clamp 31. The fixation clamp 31 is attached to the supporting rod 26 so as to be displaceable in the long direction of the latter. The connecting brace 32 is present in many commercially available flushing cisterns. The fixation clamp 31 is positioned on the support rod 26 in such a way that the bottom of the cage 25 rests on the floor of the cistern. The holding device according to FIG. 2*a* further comprises a bag holder 33, to which a reservoir for the flowing medium is to be attached.

The holding device according to FIG. 2*b* comprises a clamp 34, which can be fitted over the upper edge of a wall of a flushing cistern 35 so as to attach the holding device. The holding device according to FIG. 2*b* is provided in particular for so-called surface-type cisterns. Surface-type cisterns usually have a removable lid, so that the holding device can be set into the cistern from above and installed in a simple manner. The support rod 26, the tube holder 27 and the cage 25 are constructed in the same way as shown in FIG. 2*a*.

The holding device according to FIG. 2*c* comprises a double-clamp holder 36. By means of the double-clamp holder 36 the holding device can be attached, for example, to a pipe section that is present in many commercially available flushing cisterns. The support rod 26, the tube holder 27 and the cage 25 are constructed in the same way as shown in FIG. 2*a*.

In all three embodiments of the holding device the length of the support rod. 26 can be adjusted to suit the geometric properties of the flushing cistern by means of the preformed break sites 28. In principle, all suitable fixation means can be used to fix the holding device within the cistern. For example, the holding device in accordance with the invention can also be attached to the cistern 20 by means of a suction cup or an adhesive connection. The hinge joint 29 between the holding rod 26 and the cage 25 has the advantage that the holding device can even be inserted into the cistern "around a corner". This is particularly needed in the case of concealed cisterns, the interior of which is usually accessible only by way of a relatively small opening in the side wall. The hinge joint 29 offers the additional advantage that the support rod 26 can be mounted diagonally in the cistern 20 while the cage 25 is positioned vertically in the cistern 20, if the spatial conditions in the interior of the cistern 20 require such an arrangement.

Figure 3:
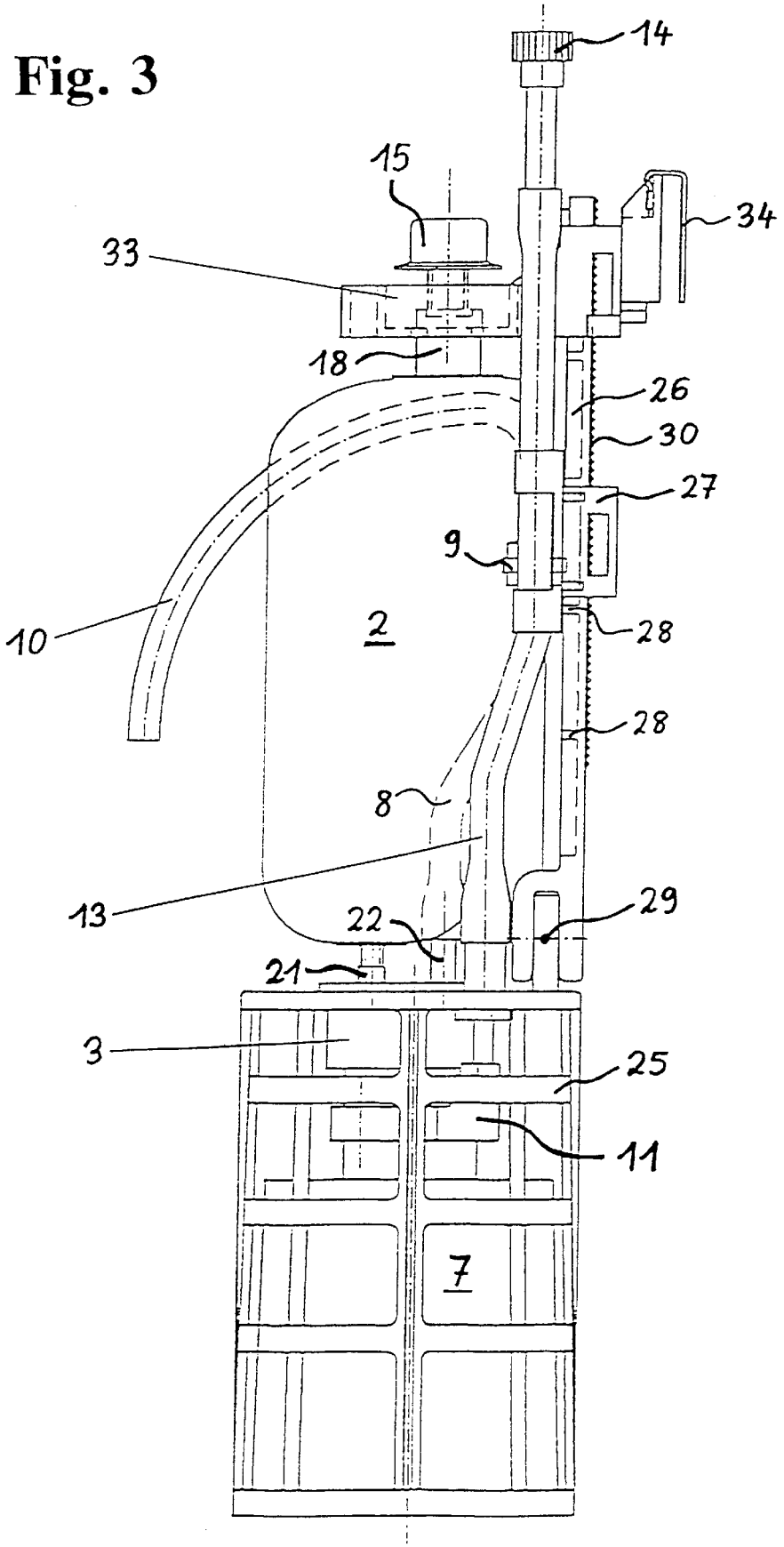
FIG. 3 is a side view of the apparatus with installed holding device in accordance with the invention.

FIG. 3 shows a holding device according to FIG. 2*b*, onto which the apparatus according to FIG. 1 is mounted. The reference numerals in FIG. 3 are the same as those in FIGS. 1 and 2*b*. The diaphragm pump with float 7 is within the cage 25. The cage 25 serves to protect the diaphragm pump and the float 7. In addition, the cage 25 is provided in order to ensure a vertical up- and downward movement of the float 7. Finally, the cage 25 is intended to ensure that the diaphragm pump and the float 7 are disposed vertically within the cistern. The cage 25 should be so disposed that its lower surface rests on the floor of the flushing cistern 20.

The apparatus according to FIG. 3 further comprises, situated above the diaphragm pump, a flexible bag 2 that serves as a reservoir for the free-flowing medium. The bag 2 is connected to the diaphragm pump by way of the input connection 21. The bag also comprises a filler neck 18 and a cap nut 15. The filler neck 18 of the bag 2 is attached to the bag holder 33. The bag 2 is so constructed that it is flexible and receives the free-flowing medium withour air inclusions. The free-flowing medium within the bag 2 can be replenished with no entry of air by way of the filler neck 18. The bag 2 is sealed off from the exterior in an airtight manner. As the flowing medium is being removed by means of the diaphragm pump, the bag 2 contracts so that no air can be sucked in from outside. The filler neck 18 can be closed in an airtight manner by the cap nut 15. Thus a chemical reaction between the flowing medium and air is largely prevented.

The diaphragm pump also comprises a stop 11, which limits the upward movement of the float 7. The height of the stop 11 can be varied by means of an adjuster screw 14. The stop 11 and the adjuster screw 14 are joined to one another by means of a flexible threaded connector or the like. In addition, the stop 11 and adjuster screw 14 are joined by an elastic tube 13, which encloses the flexible threaded connector in a watertight manner. By means of the adjuster screw 14, the maximal height of the float 7 can be adjusted by an action performed in the upper region of the flushing cistern 20. The effect is to regulate the dosage of flowing medium and to adapt the apparatus to different flushing cisterns. Because the adjuster screw 14 is situated at the upper end of the apparatus, it is easily accessible from outside. The elastic tube 13 is attached to the support rod 26 by way of the tube holder 27. The tube holder 27 can be displaced along the support rod 26 and engaged with the toothed rack 30.

The apparatus further comprises a nonreturn valve 9, which is likewise attached to the support rod 26 by means of a holder not shown here. The nonreturn valve 9 is connected to the output 22 of the diaphragm pump by way of a transport tube 8. The nonreturn valve 9 is also connected to an outlet tube 10. The nonreturn valve 9 is so arranged that the flowing medium can flow only in the direction from the transport tube 8 to the outlet tube 10. The end of the outlet tube 10 that is away from the nonreturn valve 9 is open. The outlet tube 10 is disposed within the flushing cistern in the shape of an upside-down U. The open end of the outlet tube 10 is at the level of the bag 2.

In the apparatus in accordance with the invention a pumping cycle corresponds to the process of flushing and the subsequent filling of the cistern. If the flowing medium consists of an already formed foam, the result is to introduce foam into the flushing water, so that it enters the toilet bowl along with the water. The mixture of flushing water and foam thus produced makes a considerable contribution to damping the noise associated with flushing. The water/foam mixture can also be produced if the flowing medium is a foaming agent. In this case, as the flowing medium is slowly added to the flushing water, because of the turbulence during filling of the flushing cistern the water/foam mixture is created.

A fragrance and/or disinfectant can advantageously be added to the flowing medium.

Most of the commercially available WC flushing cisterns can be retrofitted by simple means with the apparatus in accordance with the invention.

LIST OF REFERENCE NUMERALS

2 Bag
3 Pump housing
4 Dosing chamber
5 Diaphragm
6 Actuating plunger
6*a* Contact surface
7 Float
8 Transport tube
9 Nonreturn valve
10 Outlet tube
11 Stop
12 Vent
13 Elastic tube
14 Adjuster screw
15 Cap nut
18 Feeder pipe/tube
20 Fluid container
21 Input
22 Output
23 Flow-through opening
24 Diaphragm chamber
25 Cage
26 Support rod
27 Tube holder
28 Preformed break sites
29 Hinge joint
30 Toothed rack
31 Fixation clamp
32 Transverse connecting brace
33 Bag holder
34 Clamp
35 Wall of flushing cistern
36 Double-clamp holder

What is claimed:

1. An apparatus for releasing a free-flowing medium into a fluid container (20) forming a flushing cistern of a water closet, the apparatus including a diaphragm pump having an input and an output (22) and having an actuating plunger (6) that cooperates with a diaphragm (5), a float (7) connected to and moving the plunger up and down responsive to change in the water level within the fluid container (20); and having a reservoir (2) for the free-flowing medium coupled to the pump input (21) and having a nonreturn valve (9) connected to the pump output (22), the improvement comprising the diaphragm (5) constructed with a sacklike form having a lower curved end wall and the actuating plunger (6) engages the end wall and said plunger is constructed and arranged that the movement thereof responsive to increasing water level in the fluid container indents the sack (5) and the sack encloses a contact surface (6*a*) of the plunger (6) thus dispensing a measured amount of medium to the fluid container and including a cage (25) mounted with the diaphragm pump and located with said float (7) moving within said cage.

2. The apparatus of claim 1, comprising a holding device connected to said fluid container to support the pump and/or the cage.

3. The apparatus of claim 1, wherein said reservoir (2) is constructed as a flexible bag (2).

4. The apparatus of claim 1, including an adjustable stop (11) located in the upward path of the float (7).

5. An apparatus for releasing a free-flowing medium into a fluid container (20) forming a flushing cistern of a water closet, the apparatus including a diaphragm pump having an input and an output (22) and having an actuating plunger (6) that cooperates with a diaphragm (5), a float (7) connected to and moving the plunger up and down responsive to change in the water level within the fluid container (20); and having a reservoir (2) for the free-flowing medium coupled to the pump input (21) and having a nonreturn valve (9) connected to the pump output (22), the improvement comprising the diaphragm (5) constructed with a sacklike form having a lower curved end wall and the actuating plunger (6) engages the end wall and said plunger is constructed and arranged that the movement thereof responsive to increasing water level in the fluid container indents the sack (5) and the sack encloses a contact surface (6*a*) of the plunger (6) thus dispensing a measured amount of medium to the fluid container, and said reservoir is constructed as a flexible bag made of multilayered film impermeable to solvent vapor alcohol.

6. The apparatus of claim 5 wherein said flexible bag (2) is a multilayered film selected from the group consisting of aluminum, (plasticized) PVC and polyethylene film.

7. An apparatus for releasing a free-flowing medium into a fluid container (20) forming a flushing cistern of a water closet, the apparatus including a diaphragm pump having an input and an output (22) and having an actuating plunger (6) that cooperates with a diaphragm (5), a float (7) connected to and moving the plunger up and down responsive to change in the water level within the fluid container (20); and having a reservoir (2) for the free-flowing medium coupled to the pump input (21) and having a nonreturn valve (9) connected to the pump output (22), the improvement comprising the diaphragm (5) constructed with a sacklike form having a lower curved end wall and the actuating plunger (6) engages the end wall and said plunger is constructed and arranged that the movement thereof responsive to increasing water level in the fluid container indents the sack (5) and the sack encloses a contact surface (6*a*) of the plunger (6) thus dispensing a measured amount of medium to the fluid container, and wherein said diaphragm (5) has a substantially constant diameter to the curved end wall and said actuating plunger (6) has a sack engaging contact surface substantially equal to ¼ to ⅕ of the diameter of the diaphragm (5).

8. An apparatus for releasing a free-flowing medium into a fluid container (20) forming a flushing cistern of a water closet, the apparatus including a diaphragm pump having an input and an output (22) and having an actuating plunger (6) that cooperates with a diaphragm (5), a float (7) connected to and moving the plunger up and down responsive to change in the water level within the fluid container (20); and having a reservoir (2) for the free-flowing medium coupled to the pump input (21) and having a nonreturn valve (9) connected to the pump output (22), the improvement comprising the diaphragm (5) constructed with a sacklike form having a lower curved end wall and the actuating plunger (6) engages the end wall and said plunger is constructed and arranged that the movement thereof responsive to increasing water level in the fluid container indents the sack (5) and the sack encloses a contact surface **(6*a*) of the plunger (6) thus dispensing a measured amount of medium to the fluid container and wherein a transport tube (8) connects the nonreturn valve (9) to the pump output (22)**.

9. An apparatus for releasing a free-flowing medium into a fluid container (20) forming a flushing cistern of a water closet, the apparatus including a diaphragm pump having an input and an output (22) and having an actuating plunger (6) that cooperates with a diaphragm (5), a float (7) connected to and moving the plunger up and down responsive to change in the water level within the fluid container (20); and having a reservoir (2) for the free-flowing medium coupled to the pump input (21) and having a nonreturn valve (9) connected to the pump output (22), the improvement comprising the diaphragm (5) constructed with a sacklike form having a lower curved end wall and the actuating plunger (6) engages the end wall and said plunger is constructed and arranged that the movement thereof responsive to increasing water level in the fluid container indents the sack (5) and the sack encloses a contact surface **(6*a*) of the plunger (6) thus dispensing a measured amount of medium to the fluid container and wherein said nonreturn valve (9) has an output side, a medium-outlet tube (10) is located within the fluid container (20)** and connected to said output side and having an open end substantially at the level of the diaphragm pump.

10. An apparatus for releasing a free-flowing medium into a fluid container (20) forming a flushing cistern of a water closet, the apparatus including a diaphragm pump having an input and an output (22) and having an actuating plunger (6) that cooperates with a diaphragm (5), a float (7) connected to and moving the plunger up and down responsive to change in the water level within the fluid container (20); and having a reservoir (2) for the free-flowing medium coupled to the pump input (21) and having a nonreturn valve (9) connected to the pump output (22), the improvement comprising the diaphragm (5) constructed with a sacklike form having a lower curved end wall and the actuating plunger (6) engages the end wall and said plunger is constructed and arranged that the movement thereof responsive to increasing water level in the fluid container indents the sack (5) and the sack encloses a contact surface **(6*a*) of the plunger (6) thus dispensing a measured amount of medium to the fluid container, and said reservoir is a flexible bag (2) constructed and configured with engagement of at least one side wall of the fluid container (20), said engagement supporting said flexible bag (2)**.

11. An apparatus for releasing a free-flowing medium into a fluid container (20) forming a flushing cistern of a water closet, the apparatus including a diaphragm pump having an input and an output (22) and having an actuating plunger (6) that cooperates with a diaphragm (5), a float (7) connected to and moving the plunger up and down responsive to change in the water level within the fluid container (20); and having a reservoir (2) for the free-flowing medium coupled to the pump input (21) and having a nonreturn valve (9) connected to the pump output (22), the improvement comprising the diaphragm (5) constructed with a sacklike form having a lower curved end wall and the actuating plunger (6) engages the end wall and said plunger is constructed and arranged that the movement thereof responsive to increasing water level in the fluid container indents the sack (5) and the sack encloses a contact surface **(6*a*) of the plunger (6) thus dispensing a measured amount of medium to the fluid container and wherein said diaphragm pump comprises a diaphragm chamber (24) having the lower portion of sacklike diaphragm (5) and the actuating plunger (6) extending into engagement including the end wall of the diameter, and said diaphragm chamber (24) having openings (23) establishing fluid communication with the fluid container (20)**.

12. The apparatus of claim 11, wherein said diaphragm chamber (24) includes vents through for passage of air from the diaphragm chamber (24).

* * * * *

UNITED STATES PATENT AND TRADEMARK OFFICE
Certificate

Patent No. 6,289,525 B1 Patented: September 18, 2001

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Friedbert Prommer, Reicharthausen, Germany; Stanislaw Tomkow, Wrozlaw, Poland; and Bruno Neff, Reicharthausen, Germany.

Signed and Sealed this Twenty-third Day of September 2003.

GREGORY L. HUSON
*Acting Supervisory Patent Examiner*
Art Unit 3751